US006565425B1

(12) United States Patent
Wuensch

(10) Patent No.: US 6,565,425 B1
(45) Date of Patent: May 20, 2003

(54) HAND-HELD GRINDING MACHINE

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/806,100

(22) PCT Filed: Jun. 30, 2000

(86) PCT No.: PCT/DE00/02127

§ 371 (c)(1),
(2), (4) Date: May 17, 2001

(87) PCT Pub. No.: WO01/10598

PCT Pub. Date: Feb. 15, 2001

(30) Foreign Application Priority Data

Aug. 5, 1999 (DE) ..... 199 37 014

(51) Int. Cl.[7] ..... B24B 21/00
(52) U.S. Cl. ..... 451/309; 451/355
(58) Field of Search ..... 451/296, 309, 451/355, 513, 533, 531, 538, 539

(56) References Cited

U.S. PATENT DOCUMENTS 661,282 A * 11/1900 Bachman ..... 451/513
1,587,124 A 6/1926 Lacy

FOREIGN PATENT DOCUMENTS

| | | |
|---|---|---|
| DE | 44 32 976 A | 3/1996 |
| GB | 2 293 122 A | 3/1996 |
| WO | 94 03308 A | 2/1994 |

* cited by examiner

*Primary Examiner*—M. Rachuba
(74) *Attorney, Agent, or Firm*—Micheal J. Striker

(57) ABSTRACT

A power belt sander (10) with a housing (11), which contains means for driving a sanding belt (24) which can be continuously guided by means of a drive roller (23), preferably also by means of a deflection roller (22), is less costly, lighter in weight, and more efficient due to the fact that the sanding belt (24) is supported by a toothed sanding belt (21), wherein the toothed sanding belt (21) is oriented with its toothed side (25) toward the drive roller (23), preferably the guide roller (22).

11 Claims, 4 Drawing Sheets

HAND-HELD GRINDING MACHINE

BACKGROUNG OF THE INVENTION

The invention relates to a power belt sander.

A power belt sander of this generic type has been disclosed by GB 2 293 122, in which the power of a motor is transmitted by means of a drive roller to a sanding belt, which travels over a deflection roller spaced apart from and parallel to the drive roller. At the same time, there is frictional adhesion between the inside of the sanding belt and the deflection and drive rollers.

In order to assure the frictional adhesion between the sanding belt and the drive roller, the sanding belt traveling over the drive roller must be prestressed in relation to it with a minimum force. This is achieved by virtue of the fact that the deflection roller is supported so that it can be elastically displaced and is supported so that it is prestressed against the inside of the sanding belt. Tension elements are required for this, which attempt to press the deflection roller elastically away from the drive roller.

The slippage required for the power transmission between the drive roller and the sanding belt causes a relatively intense wear on the drive roller friction cover, which is usually made rubber. In addition, the sanding belt and the drive roller are heated relatively intensely by the slippage. This increases the tendency of the sanding agent layer to clog up and the tendency of the work piece surface to become lubricated, for example with paint residue or lacquer, which are already intensely heated anyway during the sanding. In the extreme case, surface regions of the work piece can become heat blackened.

Due to the heating and the slippage, the inside of the sanding belt becomes continuously smoother so that the service life of the sanding belt and the service the drive roller are reduced.

In addition, with the known power belt sanders, the continuous sanding belt, which is guided by frictional adhesion, must be kept in a central running position in relation to the drive roller and the guide roller by means of a complex adjusting device in order to prevent it from coming off the side of the drive roller and the deflection roller.

SUMMARY OF THE INVENTION

The power belt sander according to the Invention can be produced at a lower cost, is lighter in weight, and can be smaller in design than the known machines because the adjusting and tensioning means are no longer necessary. Moreover, the positive engagement between the drive roller and the sanding belt permits a quasi slip-free transmission of power to the sanding belt and results in an extended service life of the sanding belt and greater sanding abrasion.

Since a toothed sanding belt, as a support for the sanding belt, is guided on matched denticulations of the drive roller and deflection roller, the sanding belt does not have to be centered or elastically prestressed because even with the relatively low tension of the toothed sanding belt, the positive engagement between the drive roller and the uniform revolution of the toothed sanding belt are assured.

The slippage between the toothed sanding belt and the sanding belt can be minimized by virtue of the fact that on its back side, the toothed sanding belt supports the sanding belt so that it is secured against relative movement, e.g. by means of an adhesive connection or a hook-and-loop fastener.

Because the sanding belt is open, i.e. has two ends and does not constitute a closed ring, it is cheaper to produce and is easier to mount in abutting fashion on the power belt sander or on the toothed sanding belt.

For the case in which the toothed sanding belt has a sanding agent layer glued, vulcanized, or injection molded in place on its back side, the toothed sanding belt, with a particularly long service life, performs the function of the sanding belt, whose initial cost and installation are then rendered superfluous.

A clogging of the abutting point between the ends of the sanding belt with sanding dust is counteracted by virtue of the fact that one end of the sanding belt is thicker than the other and is disposed before the thinner end in the rotation direction of the sanding belt.

The fact that the ends of the sanding belt extend parallel to each other, diagonal to the travel direction effectively further counteracts the clogging of the impact point.

By virtue of the fact that instead of the toothed sanding belt, a V-belt or flat belt are used and instead of the drive roller and deflection roller, V-belt wheels or flat belt wheels are used, the above-mentioned advantages can be achieved in a manner similar that of a toothed sanding belt.

Because the toothed sanding belt, flat belt, or V-belt has recesses on its back side for the insertion of sanding segments, separate sanding segments can be disposed overlapping one another and can be individually replaced when they become worn.

By virtue of the fact that the tooth points of the toothed sanding belt are provided with a low-friction cover, in particular a textile cover, the toothed belt can be guided via a sliding shearing force and during sanding, is supported against this sliding shearing force so that it is possible for the sanding belt to exert a uniform distribution of force on the work piece.

The above-mentioned advantage that over its entire width or over its entire lower surface area oriented toward a work piece to be machined, the sanding belt is supported uniformly on the work piece, is improved by virtue of the fact that the sanding shoe which serves to support the sanding belt in relation to a work piece, is recessed in groove fashion in the vicinity of the toothed sanding belt so that its distance from the back side of the sanding belt and the back side of the toothed sanding belt is approximately equally small.

BRIEF DESCRIPTION OF THE DRAWINGS

The current invention will be described in detail below in an exemplary embodiment in conjunction with accompanying drawings.

DESCRIPTION OF THE PREFERRED EMBODIMENTS

Figure 1:
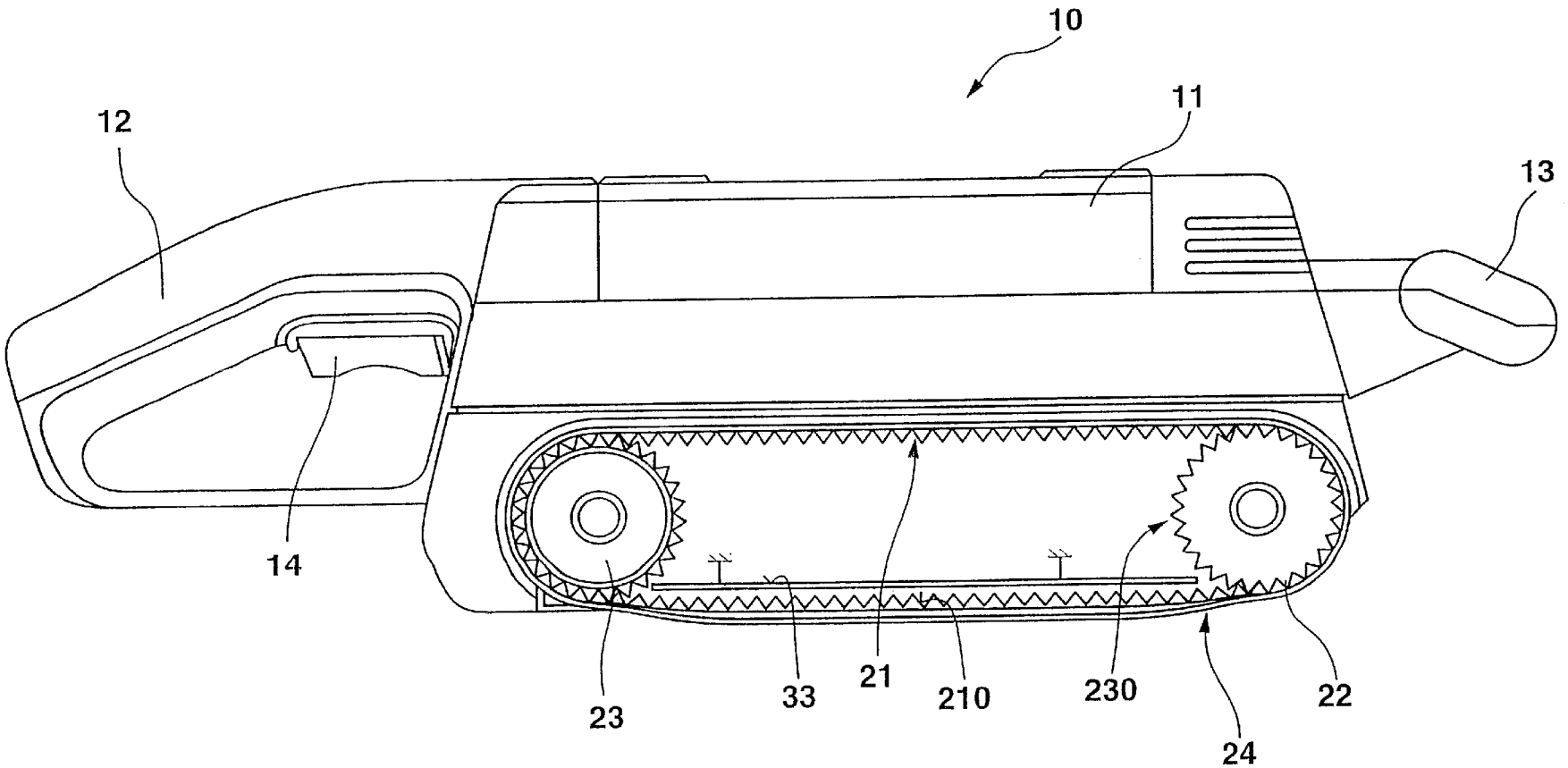
FIG. 1 shows the side view of a power belt sander according to the invention.

The side view of a power belt sander 10 in FIG. 10 shows its housing 11, which has a rear handle 12 with a switch button 14 and has a front auxiliary handle 13. The toothed belt deflection gear 22 and toothed belt drive gear 23 that are located at the bottom of the power belt sander 10 can also be seen, which continuously carry a toothed sanding belt 21 along with them.

On its side remote from the teeth 21, the toothed sanding belt 21 has hook-and-loop hooks 31 which engage with a velour layer 32 (FIG. 7) on the back side of the sanding belt 24, i.e. on the side opposite from its sanding agent layer 30. The hook/velour system 31, 32 attaches the sanding belt 24 to the toothed sanding belt 21 so that it is secured against relative movement. When its teeth 210 engage in the complementary denticulation 230 of the toothed belt deflection gear 22 and the toothed belt drive gear 23, this toothed sanding belt 21 is carried along in a positively engaging fashion and therefore experiences only minimal slippage.

Figure 5:
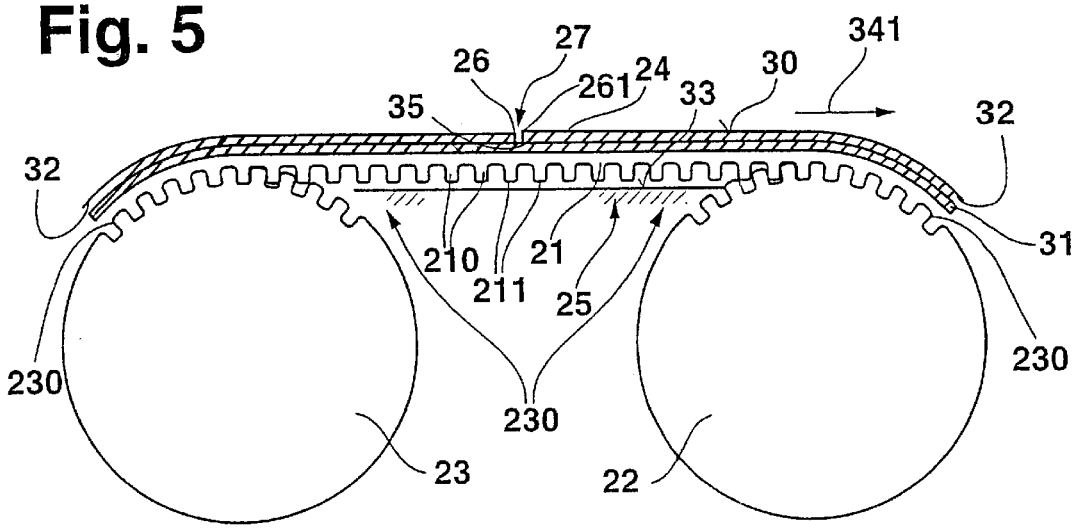
FIG. 5 shows a schematic representation of the drive roller and deflection roller with the toothed sanding belt and the sanding belt.
Figure 6:
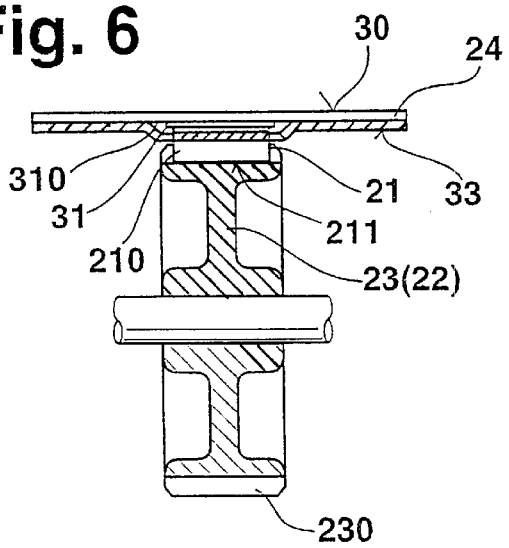
FIG. 6 shows a cross section through the drive roller and deflection roller with the toothed sanding belt and the sanding belt.
Figure 7:
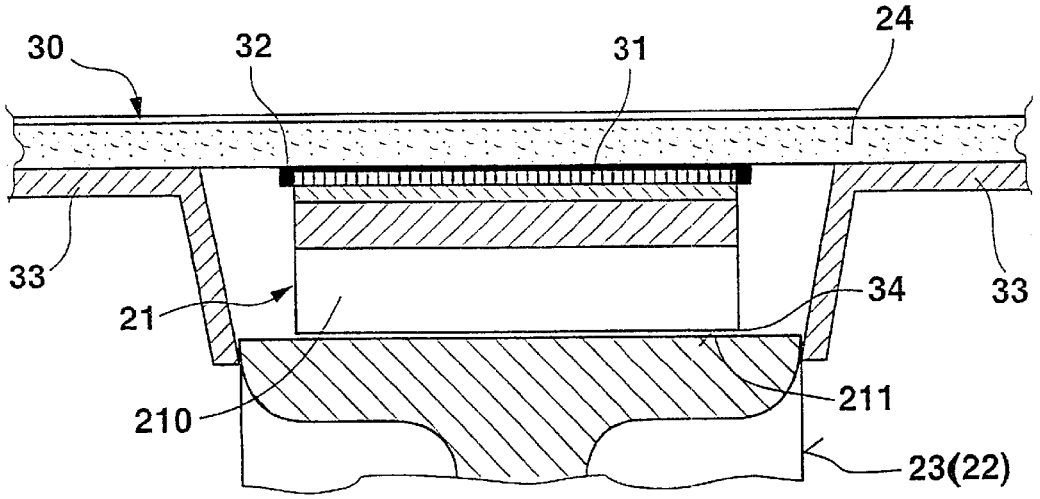
FIG. 7 is an enlarged depiction of the engagement region between the deflection roller and drive roller and the toothed belt.

The sanding belt 24 and the toothed sanding belt 21 are supported with their back sides against a sanding shoe 33 so that for sanding, the sanding belt 24 can be placed against a work piece with pressure distributed evenly over its surface area. This assures a uniform removal of material from the work piece over the entire contacting surface area or over the sanding agent layer 30 of the sanding belt 24 (FIGS. 5 to 7).

Figure 2:
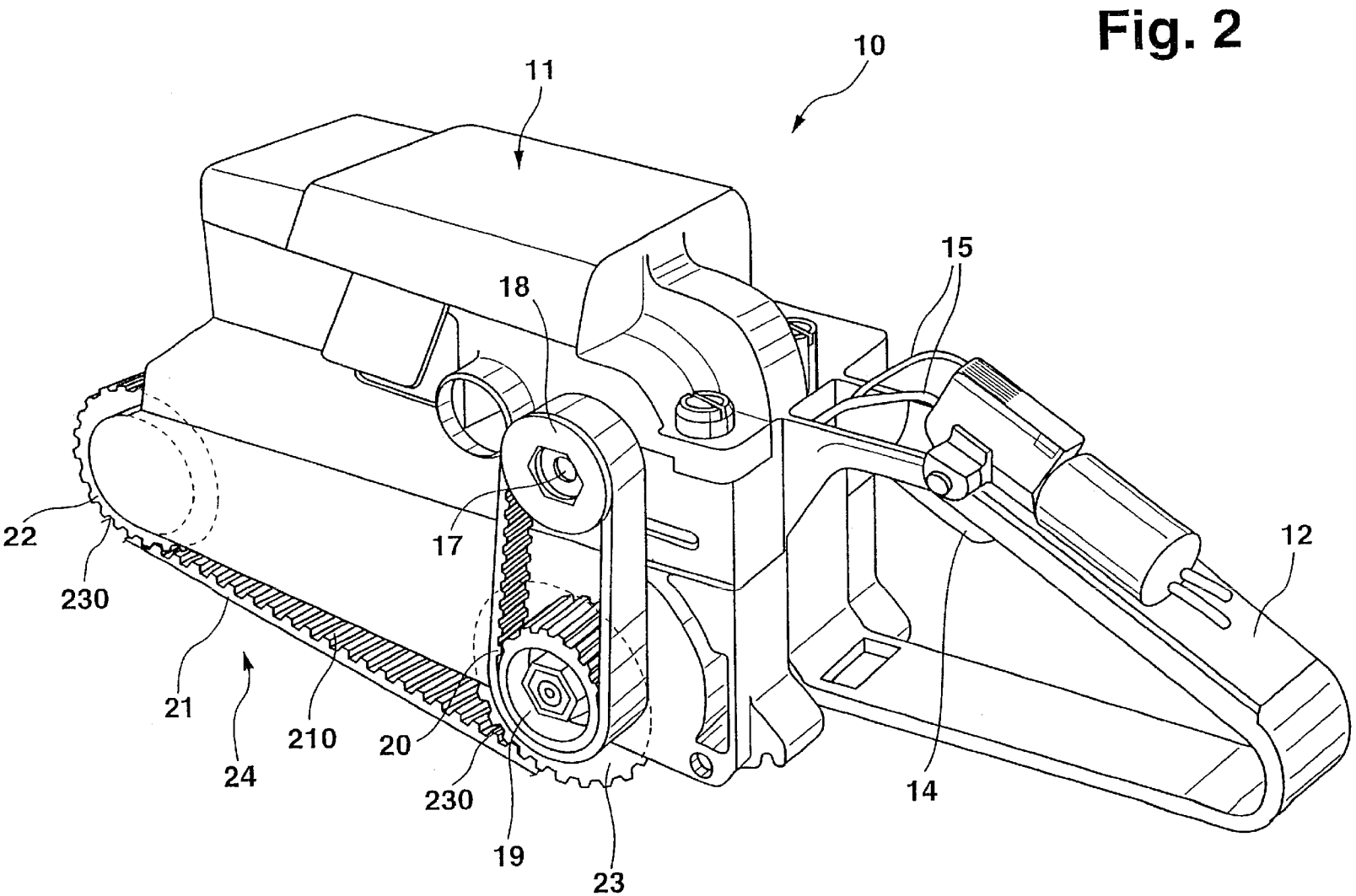
FIG. 2 is a three-dimensional oblique rear view of the power belt sander according to FIG. 1, without the side casing.

FIG. 2 is a three-dimensional depiction of the power belt sander 10 from the left rear, without a casing that covers the main handle 12 and without an auxiliary handle according to FIG. 1. The main handle 12 has a switch button 14 for a switch that is not shown in detail.

Figure 4:
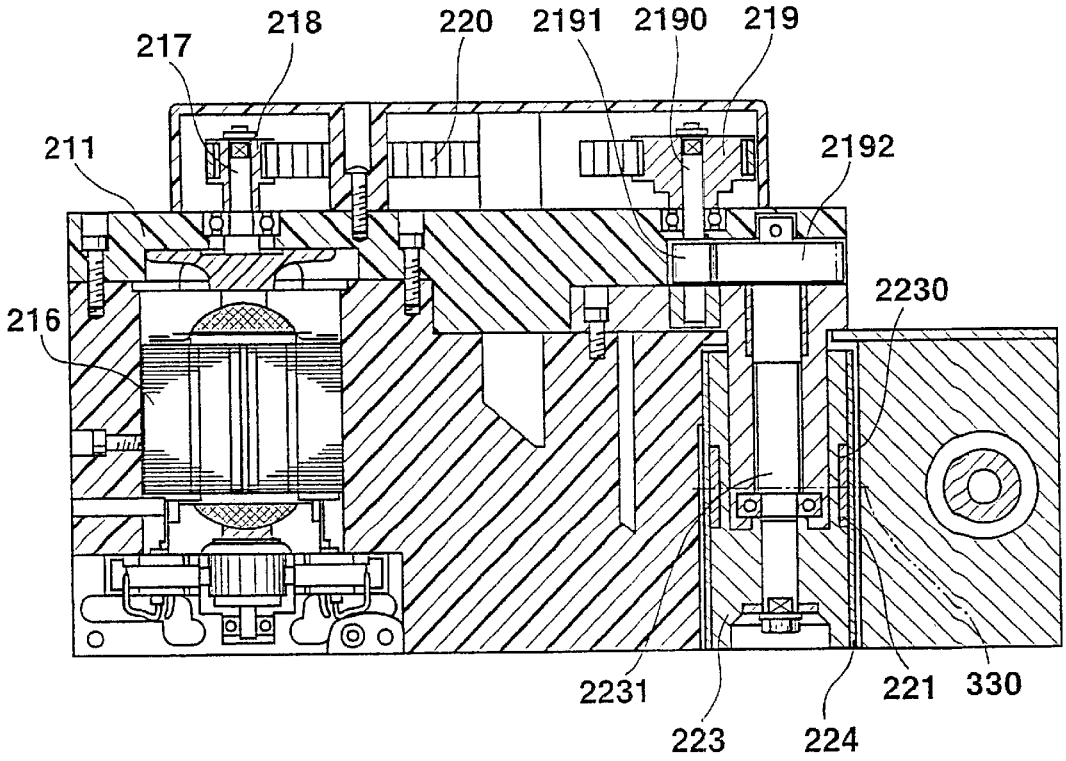
FIG. 4 shows a cross section through the power belt sander according to FIG. 3.

In the vicinity of the main handle 12, electrical lines 15 are shown which are used to supply energy to the motor 16 (FIG. 4). A drive shaft protruding from the left side of the housing 11 supports a toothed belt drive pinion 18. This drive pinion is associated with a toothed belt driven pinion 19, which is disposed axially parallel to the drive pinion, lower down in the housing 11 and is affixed in a rotationally secure fashion to the toothed belt drive gear 23 of the power belt sander 10. The two pinions 18, 19 are engaged from the outside by a toothed drive belt 20 so that the motor rotation is transmitted to the toothed belt drive gear 23.

In the front, lower region of the housing 11, the toothed belt deflection gear 22 is shown, which together with the toothed belt drive gear 23, is encompassed by the toothed sanding belt 21; the sanding belt 24, not shown, can be fastened to the back side of the toothed sanding belt 21 by means of a hook-and-loop fastening system. The drawing also shows the teeth 210 of the toothed sanding belt 21 and the counterpart denticulation 230 of the toothed belt drive gear 23 and the toothed belt driven gear 22.

Figure 3:
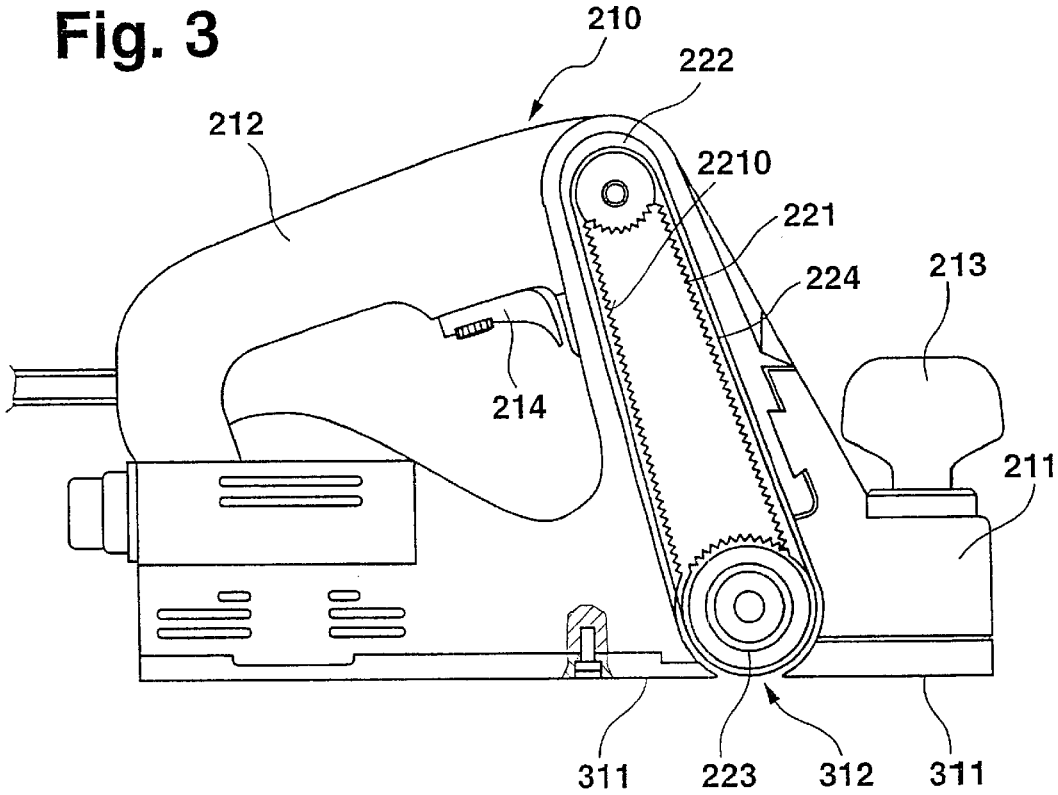
FIG. 3 shows a side view of a another exemplary embodiment of a power belt sander.

FIG. 3 shows a side view of another exemplary embodiment of a particular type of power belt sander 210, having a housing 211 with a handle 212 that has a switch button 214 for switching the drive motor 216 on and off (FIG. 4) in order to operate the power belt sander 210. In the front region of the housing 211, there is an auxiliary handle 213 for securely guiding the power belt sander 210 with both hands. In the upper region of the housing 211, the toothed sanding belt 221 is guided around a toothed belt deflection gear 222.

The exceptional feature of the power belt sander 210 is comprised in that the sanding belt 224 protrudes through a slot-like opening 312 on the machine sole 311 in a design similar to a plane, only in the circumference region of the toothed belt drive gear 223 and can therefore be placed on a work piece and is comprised in that as a result, the power belt sander 210 constitutes a modified roll sander.

FIG. 4 shows the power belt sander 210 in a longitudinal section through the toothed belt drive gear 223, which simultaneously supports and guides the sanding belt 224 along its non-toothed circumference and with this sanding belt 224, is provided to be placed on a work piece to be machined so that the sanding belt 224 can be brought into contact with a work piece only along a line.

The motor 216 is disposed in the lower region of the housing 211, with a drive shaft 217 which supports a toothed belt drive pinion 218. A toothed drive belt 220 is guided around this toothed belt drive pinion 218 and around a toothed belt driven pinion 219 that is axially parallel to and spaced apart from the drive pinion 218.

The toothed belt driven pinion 219 is supported in a non-rotatable fashion on a drive shaft 2190 which also supports a pinion 2191, which meshes with a gear 2192. This gear is non-rotatably supported on a drive shaft 2231 which in turn supports a toothed belt drive gear 223 which is used to drive a sanding belt 224 with its sanding agent layer 330. To that end, the toothed belt drive gear 223 is provided with a denticulation 2230 that is disposed in the center and is recessed in a groove-like fashion, which the toothed sanding belt 221 engages in with its teeth 2210. The groove-like recessed denticulation 2230 is dimensioned so that the toothed sanding belt 221 that meshes with it fits into it in a flush manner. As a result, the contour of the back of the toothed sanding belt 221 is flush with the smooth contour of the non-toothed region of the toothed belt drive gear 223 on both sides of the denticulation 2230.

The toothed belt drive gear 223 simultaneously serves as a first deflection roller of the sanding belt 224 and also absorbs the support force when the power belt sander 210 is placed on a work piece and/or during machining of the work piece. In this connection, the sanding belt 224 is supported with its inside against the toothed belt drive gear 223 and is coupled to the toothed sanding belt 221 in a driven fashion only by means of a central velour strip (FIG. 7) and with its region protruding laterally beyond the toothed sanding belt 221, is guided in a deflecting manner with a slight support force against the smooth, non-toothed circumference of the toothed belt drive gear 223.

The toothed belt deflection gear 222 disposed in the upper region of the housing 211 is embodied similarly to the toothed belt drive gear 223 and simultaneously serves as a second deflection roller for the toothed sanding belt 221 and the sanding belt 224. With its lateral velour strip-free regions, this sanding belt 224 is also guided there in a deflecting fashion, with a slight support force against the lateral, non-toothed circumference regions of the toothed belt deflection gear 222. The central denticulation 230 of the toothed belt deflection gear 222 is also dimensioned so that the toothed sanding belt 221 that meshes with it rests with its back side flush with the non-toothed, respective lateral regions and the sanding belt 24 can be guided with its velour strip-free region continuously supported against this toothed sanding belt 221.

FIG. 5 is a schematic representation of the toothed belt drive gear 23 and the toothed belt driven gear 22 in the vicinity of their denticulation 230, which the teeth 210 of the toothed sanding belt 21 positively engage in and can be guided to rotate in a non-slip fashion.

The toothed sanding belt 21 is oriented with its toothed side 25 toward a sanding shoe 33 affixed to the housing so that when the flat region of the sanding belt 24 disposed between the toothed belt drive gear 23 and the toothed belt driven gear 22 is pressed against a work piece, the tooth points 211 of the teeth 210 of the toothed sanding belt 21 can slide along against the sanding shoe 33. As a result, the sanding shoe 33 can be used to uniformly distribute the pressure against the region of the sanding belt 24 disposed underneath it and from there onto a work piece. In order to reduce wear, the tooth points 211 are provided with a sliding cover 34 comprised of textile fibers or the like (FIG. 7).

The sanding belt 24 is connected to the back side of the toothed sanding belt 21 so as to be secured against relative movement, by means of a hook-and-velour system 31, 32. The ends of the sanding belt 24 form a butt joint 27 or a gap. The toothed sanding belt 21 is narrower than the sanding belt 24 so that only its central region is provided with a velour strip 32. This is why the sanding shoe 33, in the vicinity of the tooth points 211 of the sanding belt 24, is recessed in a groove-like fashion so that the tooth points 211 are spaced slightly apart from the corresponding region of the sanding shoe 33. Likewise, the distance of the lateral velour strip-free regions of the sanding belt 24 from the sanding shoe 33 is slight in order to be able to be supported against it over the entire surface.

The directional arrow 341 indicates the movement direction of the sanding belt 24, the toothed sanding belt 21, and the gears 22, 23. The one end 261 of the sanding belt 24 is designed to be slightly higher than the other end 26 so that dust is prevented from collecting between the two ends 261, 26, at the bottom of the step-like height difference 35 between them, i.e. in the vicinity of the butt joint or gap 27 between the ends 26 of the sanding belt 24, and so that the dust is prevented from falling out by itself during sanding.

FIG. 6 shows a cross section of the toothed belt drive gear 23 and the toothed belt deflection gear 22 with the counterpart denticulation 230 according to FIG. 5. The teeth 210 of the toothed sanding belt 21 continuously engage in a slip-free fashion in the counterpart denticulation 230.

On its back side, the toothed sanding belt 21 has hook-and-loop hooks 31 which engage in the velour layer 32 disposed on the back side of the sanding belt 24. With the back side of its velour 32 covered region, the sanding belt 24 is supported on the sanding shoe 33 and with a uniformly distributed pressure, can produce a uniform removal of material on a work piece to be machined.

FIG. 7 gives an enlarged view of the disposition of the sanding belt 24, with its outwardly pointing sanding surface 30 and the velour cover 32 on its back side. The FIG. also shows the sanding shoe 33, the hook-and-loop hooks 31 of the toothed sanding belt 21, the teeth 210 of the toothed sanding belt 21 with the sliding cover 34 disposed in the vicinity of its tooth points 211. These permit a sliding support of the continuous toothed sanding belt 21 with its back side against the sanding shoe 33 so that the inner region of the sanding belt 24 that is coupled to the toothed sanding belt 21 can also be placed against a work piece with the same pressure as at the side or in the edge region of the sanding belt 24.

What is claimed is:

1. A power belt sander (10, 210) with a housing (11, 211), which contains means for driving a sanding belt (24, 224) which can be continuously guided by a drive roller (23, 223), wherein the sanding belt (24, 224) is supported by an additional sanding belt (21, 221), wherein the additional sanding belt (21, 221) is oriented with its one sanding belt (21, 221) is oriented with its one side (25, 225) toward the drive roller (23, 223), and wherein the sanding belt (24, 224) does not constitute a closed ring, but has two ends (26, 261) which can be placed against the additional sanding belt (21, 221) so that they have a gap-like, open abutting point (27) between them.

2. The power belt sander according to claim 1, wherein the additional sanding belt (21, 221) is a toothed sanding belt and engages with teeth (210, 2210) of the toothed side (25, 225) in a respective counterpart denticulation (230, 2230) of the drive roller (23, 230).

3. The power belt sander according to claim 2, wherein on its back side (26, 226) opposite from the toothed side (25, 225), the toothed sanding belt (21, 221) supports the sanding belt (24, 224) so that it is secured against relative movement.

4. The power belt sander according to claim 1, is a toothed sanding belt and there is a hook-and-loop connection between the sanding belt (24, 224) and the additional sanding belt (21, 221).

5. The power belt sander according to claim 4, wherein the ends (26, 261) of the sanding belt (24) extend obliquely, parallel to each other.

6. The power belt sander according to claim 1, wherein on its back side (26, 226), the sanding belt (221) has a sanding agent layer (30, 330).

7. The power belt sander according to claim 1, wherein one end (261) of the sanding belt (24) is thicker than the other end (26) and can be disposed before the thinner end (26) in the rotation direction of the sanding belt and constitutes an inclined plane.

8. The power belt sander according to claim 1, wherein a guide roller formed as a deflection roller (22, 222) is provided, and wherein the additional sanding belt (21, 221) is oriented with its one side toward the guide roller (22, 222).

9. The power belt sander according to claim 8, wherein the drive roller (23) and the guide roller (22) have the counterpart denticulation (230) in a central region that is radially recessed as an annular groove so that the additional sanding belt (21) ends with its back side flush against the outer contour of the non-toothed regions of the drive roller (23) and guide roller (22), next to the counterpart denticulation (230) when the teeth (210) of this roller engage with the counterpart denticulation (230).

10. The power belt sander according to claim 1, wherein a sanding shoe (33, 133) which serves to support the sanding belt (24, 224) in relation to a work piece, is recessed in a groove-like fashion in the vicinity of the additional sanding belt (21, 221) so that its distance from the back side of the sanding belt (24, 224) and from the back side of the additional sanding belt (21, 221) is approximately equal.

11. A power belt sander (10, 210) with a housing (11, 211), which contains means for driving a sanding belt (24, 224) which can be continuously guided by a drive roller (23, 223), wherein the sanding belt (24, 224) is supported by an additional sanding belt (21, 221), wherein the additional sanding belt (21, 221) is oriented with its one side (25, 225) toward the drive roller (23, 223), wherein a hook-and-loop connection is provided between the sanding belt (24, 224) and the additional sanding belt (21, 221), and wherein the sanding belt (24, 224) does not constitute a closed ring, but has two ends (26, 261) which can be placed against the additional sanding belt (21, 221) so that they have a gap-like, open abutting point (27) between them.

* * * * *